US005208429A

United States Patent [19]

Field

[11] Patent Number: 5,208,429

[45] Date of Patent: May 4, 1993

[54] COMBINATION MUFFLER AND CHECK VALVE FOR A SCREW COMPRESSOR

[75] Inventor: Michael G. Field, Fabius, N.Y.

[73] Assignee: Carrier Corporation, Syracuse, N.Y.

[21] Appl. No.: 736,550

[22] Filed: Jul. 26, 1991

[51] Int. Cl.[5] ..... F02M 35/00; F04B 21/00; F01C 1/02

[52] U.S. Cl. ..... 181/229; 181/237; 181/254; 181/269; 417/312; 418/55.1

[58] Field of Search ..... 181/229, 233, 237, 253, 181/254, 255, 264, 269, 272, 282; 417/312; 418/55.1

[56] References Cited

U.S. PATENT DOCUMENTS

| | | | |
|---|---|---|---|
| 4,111,278 | 9/1978 | Bergman | 181/249 |
| 4,904,165 | 2/1990 | Fraser, Jr. et al. | 418/55.1 |
| 5,088,905 | 2/1992 | Beagle | 418/55.1 |

*Primary Examiner*—Michael L. Gellner
*Assistant Examiner*—Khanh Dang

[57] ABSTRACT

A weight biased check valve is located in a reflective muffler at the entrance thereof. As a result, both the check valve and muffler are located proximate to a compressor which minimizes both the package size and the volume trapped upon shutdown. The axis of the weight biased check valve is skewed whereby the weight biasing effect is reduced.

3 Claims, 1 Drawing Sheet

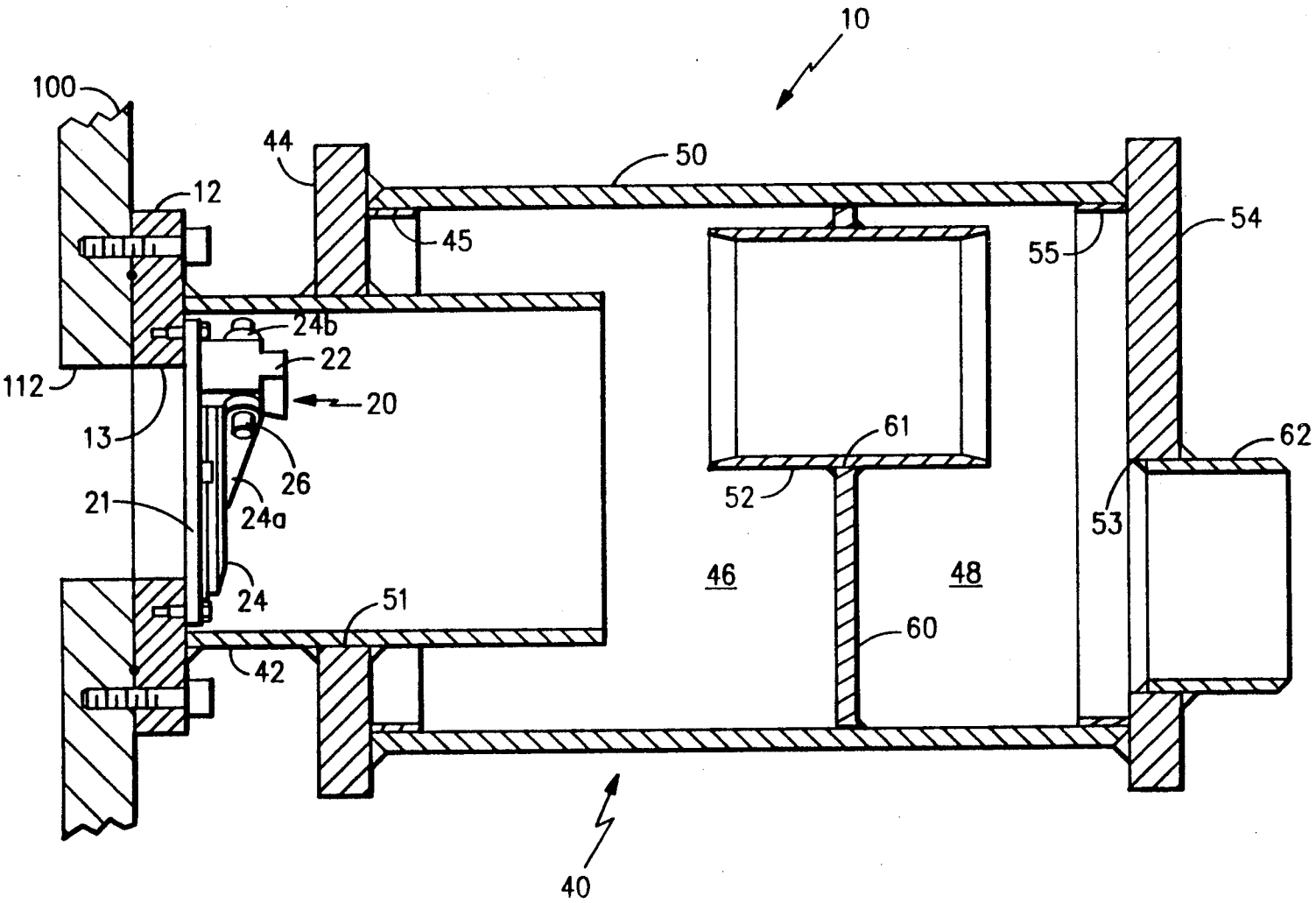
10
54
62
53
55
48
60
61
52
46
50
40
45
51
20
22
24b
26
24a
24
42
44
12
13
21
100
112

COMBINATION MUFFLER AND CHECK VALVE FOR A SCREW COMPRESSOR

BACKGROUND OF THE INVENTION

Most rotary fluid machines are capable of reverse operation. As a result, operation in one direction will cause the device to function as a pump or compressor while reverse operation will have the device operating as an expander. Normally, the fluid machine will be installed in a system where reverse flow and operation are not wanted. Specifically, where a rotary machine is intended to be operated as a pump or compressor, upon shutoff, there will be a pressure differential between suction and discharge which will tend to cause the machine to operate as an expander. A check valve is commonly used to prevent the discharge and suction sides from equalizing through the compressor. If follows that the reverse operation, if any, will be a function of the mass of a gas available for reverse flow and its pressure.

Commonly assigned U.S. Pat. No. 4,904,165 discloses a comornec muffler, separator plate and check valve for a hermetic scroll compressor. This design, however, does not address reducing the dimensions of the compressor package. Further, the muffler portion is just a chamber defined in part by perforated sheet metal.

SUMMARY OF THE INVENTION

A weight biased pivoted check valve is combined with a quarter wave length reflective muffler which is one that achieves sound reduction by cancellation. The check valve is located at the entrance to the muffler so that its opening movement is within the muffler and both the check valve and the muffler are located as close to the discharge gas port of the compressor as possible. As a result, casting or unit born vibrations caused by unmuffled pulsations and the related noise reverberating surface area are reduced. Additionally, the trapped volume of high pressure gas at shutdown is reduced together with the actual or potential reverse rotation of the helical screw rotors due to the pressure differential across the compressor.

It is an object of this invention to reduce pulsations of discharge gas during the operation of a helical rotary screw compressor.

It is another object of this invention to reduce the package size for a screw compressor.

It is a further object of this invention to reduce the amount of gas tending to cause reverse rotation upon shutdown. These objects, and others as will become apparent hereinafter, are accomplished by the present invention.

Basically, a check valve is incorporated into a reflective muffler at the entrance thereof whereby both are located proximate the discharge gas port of a screw compressor.

BRIEF DESCRIPTION OF THE DRAWING

For a fuller understanding of the present invention, reference should now be made to the following detailed description thereof taken in conjunction with the accompanying drawing wherein.

The FIGURE is a vertical sectional view through the combined check valve and muffler.

DESCRIPTION OF THE PREFERRED EMBODIMENT

In the FIGURE, the numeral 10 generally designates the combined muffler and check valve which is secured to screw compressor 100. Plate 12 carries check valve assembly 20 and has a bore 13 which is controlled by valve member 24 of check valve assembly 20. Plate 12 is suitably secured to the housing of screw compressor 100, or the like, such that the bore 13 forms a continuous flow path with the discharge 112 of the compressor 100. Tube 42 defines the inlet portion of muffler assembly 40 and is sealingly secured at one end to plate 12 so as to surround bore 13 and valve member 24. Tube 42 is welded so as to extend through bore 51 in end plate 44 into chamber 46. Annular cylindrical member 50 is welded to end plates 44 and 54 via welding rings 45 and 55. Divider plate 60 divides the interior of cylindrical member 50 into chambers 46 and 48. Tube 52 is welded to and extends through bore 61 in divider plate 60 so as to provide a fluid path between chambers 46 and 48. Tube 62 is secured in bore 53, in end plate 54 without extending into chamber 48, and extends outwardly from plate 54 to define the outlet of the muffler assembly 40.

Check valve assembly 20 includes annular valve seat member 21 which is secured to plate 12 so as to be located within tube 42 and surround and form a continuous flow path with bore 13. Pivot member 22 extends from seat member 21 downstream into tube 42. Valve member 24 has ears **24*a* and 24*b* such that pin 26 extends through bores in ears 24*a* and 24*b* and pivot member 22 so as to pivotably locate valve member 24 with respect to annular seat member 21. It will be noted that pin 26 and ears 24*a* and 24*b* are skewed which reduces the weight biasing effect of valve member 24 as well as the wear on pin 26. The reduced weight bias slows the closing action due to pressure pulsations from the compressor so that the valve member 24 does not close or chatter during normal compressor operation. The diameters of discharge 112, bore 13 and tubes 52 and 62 are essentially the same but are much smaller than the diameter of tube 42 which contains the check valve assembly 20. The projected axis of tube 42 is essentially tangent in an axial direction with the bores of tubes 52 and 62** which are, in turn, tangent with each other.

The flow path through combined muffler and check valve 10 is from discharge 112 of compressor 100 serially through bore 13 causing valve member 24 to swing open and thereby form a portion of the flow path through tube 42. Then the flow goes through tube 42 into chamber 46 from which it passes via tube 52 into chamber 48 and then exits via tube 62. Muffler assembly 40 is a quarter wave length reflective muffler. Tubes 42 and 52 extend into chamber 46 and tube 52 extends into chamber 48 but tubes 42, 52 and 62 are not coaxial. As a result plates 44, 60 and 54 reflect the sound waves as the flow is diverted in passing through muffler assembly 40 and there is a reduction in sound due to cancellation.

In operation, valve member 24 is in an open position as long as flow is from the compressor into bore 13. When the compressor stops, high pressure refrigerant in the system downstream of the compressor 100 tends to equalize through the compressor. The combination of valve member 24 being weight biased to a normally closed position plus the reverse flow acting on valve member 24 causes it to close trapping only the volume of discharge 112 and bore 13 located so as to cause reverse operation of the compressor. The extremely small volume of discharge 112 and bore 13 is insufficient to produce any significant reverse operation of the compressor.

From the foregoing description of the structure and operation it is evident that check valve assembly 20 only coacts with tube 42. The influence on the operation of muffler function of muffler assembly 40 by check valve assembly 20 is therefore limited to the modifications to tube 42 and the resulting consequences. Tube 42 must be enlarged sufficiently to receive the valve assembly 20 without providing a flow restriction in the full open position since, in the absence of valve assembly 20, tube 42 would be of the same cross section as bore 13. Thus, tube 42 is oversized to receive valve assembly 20 and tube 42 particularly the downstream end, constitutes an expansion chamber relative to bores 112 and 13. As a result, the gas goes through a preexpansion in tube 42 before reaching chamber 46 rather than having a single expansion into chamber 46, as would be conventional, and results in a slower gas flow into chamber 46 which mitigates against the inherent losses due to the presence of the check valve assembly 20.

Although a preferred embodiment of the present invention has been illustrated and described, other changes will occur to those skilled in the art. It is there intended that the scope of the present invention is to be limited only by the scope of the appended claims.

What is claimed is:

1. A combination muffler and check valve comprising:

first plate means having a bore therein and adapted to be secured to a compressor having a discharge whereby said bore forms a continuous flow path with said discharge;

check valve assembly means secured to said first plate means and including valve seat means surrounding said bore and forming a continuous flow path therewith;

first tube means secured to said first plate means and surrounding said check valve assembly means;

second plate means having a bore therein and secured to said first tube means such that said first tube means extends through said bore in said second plate means;

third plate means having a bore therein;

an annular cylindrical member having a first end secured to said second plate means and a second end secured to said third plate means;

divider means having a bore therein and located within said annular cylindrical member so as to coact with said second plate means and said cylindrical member to define a first chamber and to coact with said third plate means and said cylindrical member to define a second chamber;

second tube means located in said bore in said divider means and extending into said first and second chamber;

third tube means located in said bore in said third plate means and extending outwardly therefrom so as to define an outlet for said combination muffler and check valve.

2. The combination muffler and check valve of claim 1 wherein said first second and third tube means are axially separated and have axes which are radially spaced.

3. The combination muffler and check valve of claim 1 wherein said check valve assembly means includes a weight biased valve member pivotable about a skewed axis.

* * * * *